US008803647B2

(12) United States Patent
Saka et al.

(10) Patent No.: US 8,803,647 B2
(45) Date of Patent: Aug. 12, 2014

(54) REACTOR AND POWER CONVERTER INCORPORATING THE REACTOR

(75) Inventors: Kenji Saka, Oobu (JP); Kazuhiro Kosaka, Anjo (JP); Akira Nakasaka, Anjo (JP)

(73) Assignees: Denso Corporation, Kariya (JP); NEC Tokin Corporation, Sendai (JP)

( * ) Notice: Subject to any disclaimer, the term of this patent is extended or adjusted under 35 U.S.C. 154(b) by 999 days.

(21) Appl. No.: 11/798,779

(22) Filed: May 16, 2007

(65) Prior Publication Data

US 2007/0295715 A1 Dec. 27, 2007

(30) Foreign Application Priority Data

May 16, 2006 (JP) ..... 2006-136479
Dec. 25, 2006 (JP) ..... 2006-347900

(51) Int. Cl.
*H01F 27/02* (2006.01)
*H01F 27/08* (2006.01)
*H05B 6/12* (2006.01)

(52) U.S. Cl.
USPC ..... 336/59; 336/55; 336/82; 336/90; 219/624

(58) Field of Classification Search
USPC ..... 219/624, 630, 632; 336/82, 83, 55, 59, 336/60, 61, 221, 212, 233, 90, 192; 363/212, 233; 148/105, 301, 304; 307/7, 419
See application file for complete search history.

(56) References Cited

U.S. PATENT DOCUMENTS

| | | | | |
|---|---|---|---|---|
| 4,424,504 | A * | 1/1984 | Mitsui et al. | 336/83 |
| 2003/0231094 | A1* | 12/2003 | Funk | 336/212 |
| 2004/0074564 | A1* | 4/2004 | Brunner | 148/105 |
| 2004/0208030 | A1* | 10/2004 | Bhate et al. | 363/109 |
| 2004/0257187 | A1* | 12/2004 | Drummond et al. | 336/61 |
| 2005/0259402 | A1 | 11/2005 | Yasui et al. | |

FOREIGN PATENT DOCUMENTS

| | | | | |
|---|---|---|---|---|
| JP | 58-063716 | | 4/1983 | |
| JP | 60-16518 | | 2/1985 | |
| JP | 02-194508 | | 8/1990 | |
| JP | 05109542 | A * | 4/1993 | H01F 27/08 |
| JP | 10-241969 | | 9/1998 | |
| JP | 2002-050527 | | 2/2002 | |
| JP | 2004-273657 | | 9/2004 | |
| JP | 2005-332863 | | 12/2005 | |
| JP | 2005-354001 | | 12/2005 | |

OTHER PUBLICATIONS

English translation of Abstract of Aoki, JP 05-109542 A, Apr. 1993.*
English Translation of Disclosure of Aoki, JP 05-109542 A, Apr. 1993.*
Japanese Office Action dated Mar. 1, 2011, issued in corresponding Japanese Application No. 2006-347900 with English Translation.

* cited by examiner

*Primary Examiner* — Henry Yuen
*Assistant Examiner* — Hung D Nguyen
(74) *Attorney, Agent, or Firm* — Nixon & Vanderhye PC

(57) ABSTRACT

A reactor is provided with a coil, a core, and a case. The coil generates magnetic flux in response to supply of current thereto. The core is made of magnetic powder-containing resin filled in spaces inside and outside of the core. The case accommodates therein the coil and the core. The reactor is also provided with a cooling pipe (cooling member), which is arranged to be in contact with the core. A power converter is provided with semiconductor modules, a cooler, and the reactor. In the power converter, the cooler is arranged partially being in contact with the core of the reactor.

21 Claims, 8 Drawing Sheets

REACTOR AND POWER CONVERTER INCORPORATING THE REACTOR

CROSS-REFERENCE TO RELATED APPLICATION

This application is based on and claims the benefit of priorities from earlier Japanese Patent Application Nos. 2006-136479 and 2006-347900 filed May 16 and Dec. 25, 2006, respectively, the descriptions of which are incorporated herein by reference.

BACKGROUND OF THE INVENTION

1. Technical Field of the Invention

The present invention relates to a reactor provided with a heat radiating member for radiating heat generated by a coil, and to a power converter incorporating the reactor.

2. Related Art

A reactor is a kind of electronic parts, which is composed, for example, by winding a coil around a core made of magnetic material. Supply of current to the coil will generate magnetic flux which is distributed along the core.

Operation of the reactor with the supply of current is accompanied by generation of Joule heat from the coil. This heat generation may allow the temperature of the reactor to be excessively high, which may damage the operational stability of the reactor. The heat generation may also allow the temperature of the electronic parts surrounding the reactor to be excessively high, which may damage the operational stability of the electronic parts. As a result, a power converter, for example, incorporating such a reactor may have damage in the operational stability.

In order to suppress the temperature increase of a reactor, Japanese Patent Laid-Open No. 2002-050527 suggests a reactor provided with a heat radiation structure.

A reactor provided with such a heat radiation structure has a heat sink plate to which the reactor is arranged, so that heat radiation from an outer surface of the reactor can be accelerated.

However, depending on the shape of a reactor, it may be difficult to ensure a sufficient contact area between the reactor and the heat sink, which may bring about difficulty in improving the radiation efficiency.

In particular, the heat generated by the coil tends to stay inside the coil. Therefore, acceleration of heat generation of only the outer surface of the reactor may not exert an effect of well suppressing the temperature increase of the reactor. On the other hand, use of an iron core, for example, as in the conventional art, may present a difficulty in arranging a cooling member inside the coil.

SUMMARY OF THE INVENTION

The present invention has been made in light of the problem involved in the conventional art as mentioned above, and has as its object to provide a reactor having excellent heat radiation properties and to provide a power converter incorporating the reactor.

According to a first mode of the present invention, there is provided a reactor having a coil for generating magnetic flux with a supply of current, a core made of magnetic powder-containing resin filled in the spaces inside and outside the coil so that the core comes in contact with the coil in a direct and tight manner, a case for accommodating therein the coil and the core, and a cooling member arranged being in contact with the core.

In this reactor, the cooling member is arranged being in contact with the core made of magnetic powder-containing resin. This may ensure a large contact area between the cooling member and the reactor to allow efficient heat radiation. In particular, the core made of magnetic powder-containing resin may allow its shape to be in conformity with and in close contact with the surface of the cooling member. This may contribute to enlarging the contact area between the cooling member and the reactor.

Thus, a supply of current to the coil may cause heat generation, and the heat is transferred to the core. The heat in the core may then be radiated from the cooling member closely in contact with the core, so that heat radiation of the reactor can be efficiently performed. As a result, a reactor having excellent heat radiation properties ensured with operational stability of the reactor can be provided.

According to a second mode of the present invention, there is provided a power converter having semiconductor modules each incorporated with a semiconductor element, a cooler for cooling the semiconductor modules, and a reactor electrically connected to the semiconductor modules, the reactor having a coil for generating magnetic flux upon supply of current, a core made of magnetic powder-containing resin filled in the spaces inside and outside the coil, and a case for accommodating therein the coil and the core, wherein the cooler is arranged being partially in contact with the core of the reactor.

In the reactor of this power converter, the cooler is arranged being partially in contact with the core made of magnetic powder-containing resin. This may ensure a large contact area between the cooler and the reactor to achieve efficient heat radiation. That is, heat radiation of the reactor can be efficiently performed. As a result, operational stability is ensured for the reactor and electronic parts therearound, leading to the operational stability of the power converter. In this way, a converter can be provided, which has excellent heat radiation properties for the reactor.

DETAILED DESCRIPTION OF THE PREFERRED EMBODIMENTS (First Embodiment)

Figure 1:
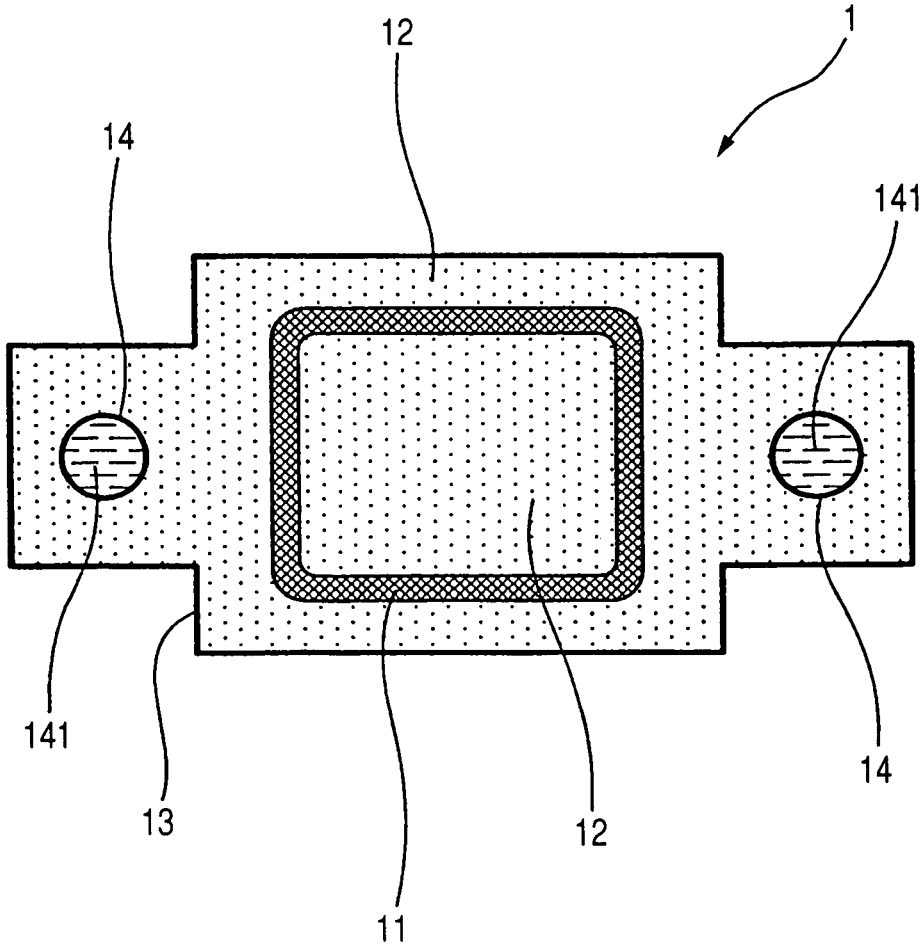
FIG. 1 is an explanatory cross sectional view illustrating a section of a reactor used in a first embodiment of the present invention.
Figure 2:
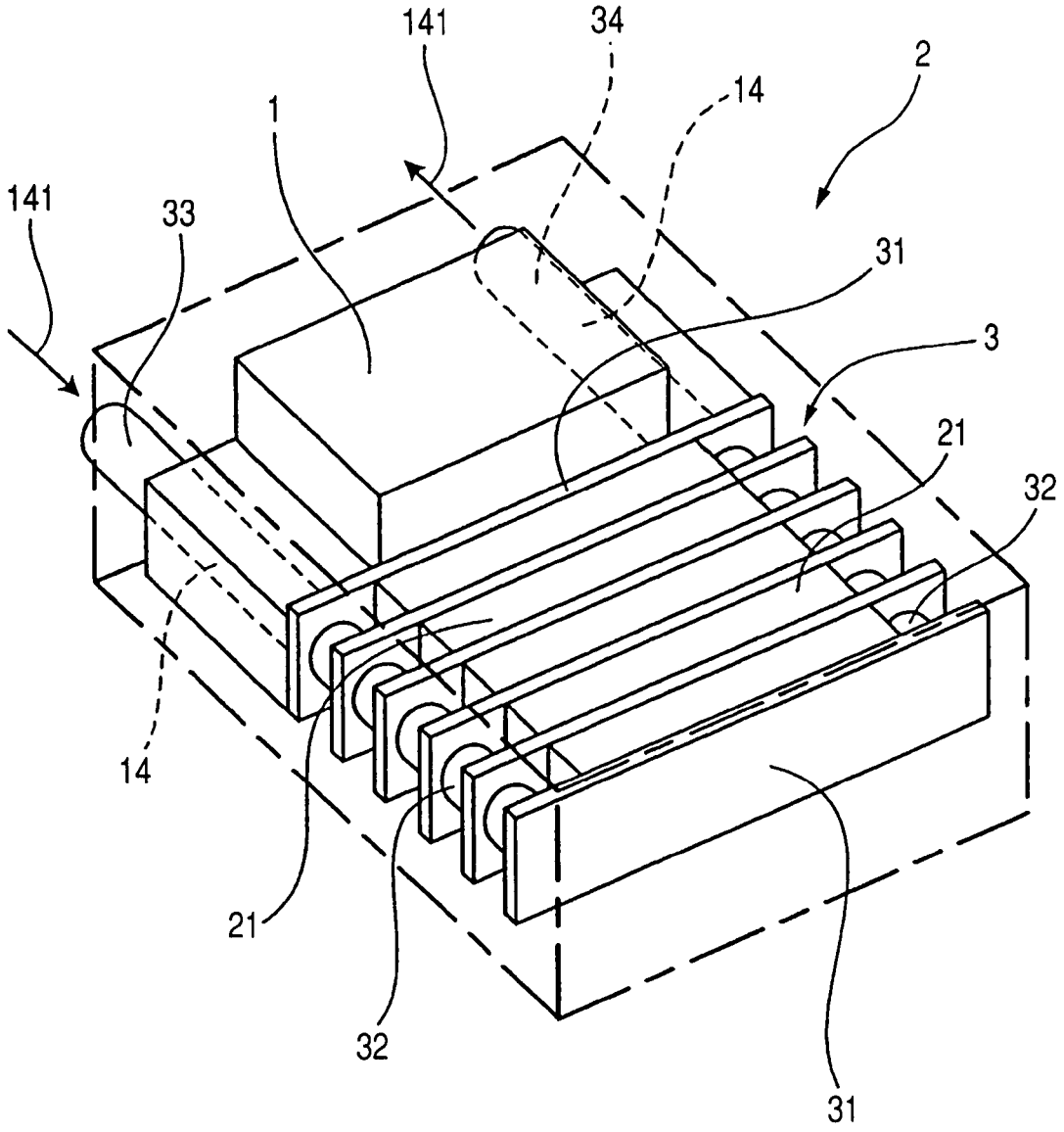
FIG. 2 is a schematic perspective view illustrating a power converter used in the first embodiment.
Figure 3:
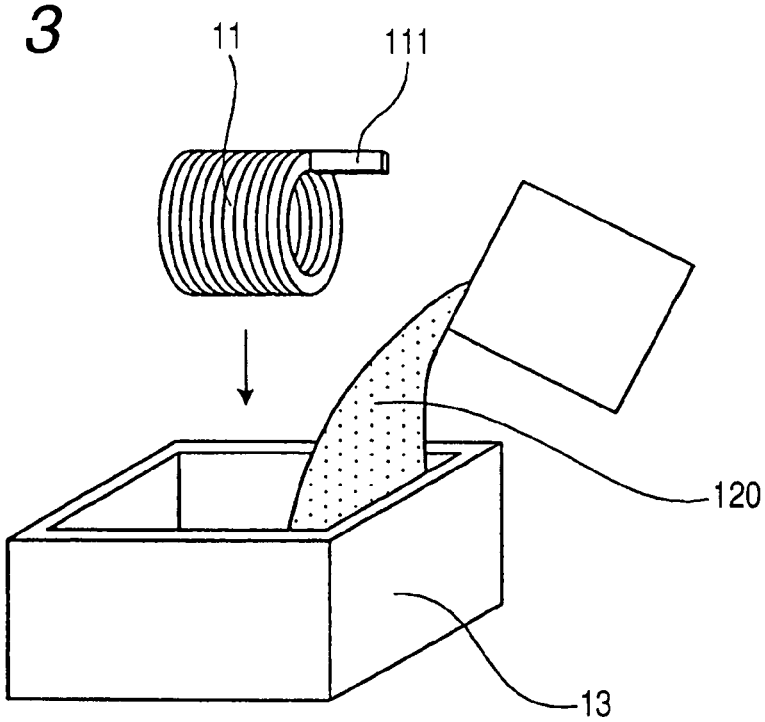
FIG. 3 is an illustration explaining how to fabricate the reactor according to the first embodiment.

With reference to FIGS. 1 to 3, hereinafter is described a reactor and a power converter using the reactor, according to a first embodiment.

As shown in FIG. 1, a reactor 1 of the present embodiment is provided with a coil 11 that generates magnetic flux upon supply of current, a core 12 made of magnetic powder-containing resin filled in the spaces inside and outside the coil 11 so that the core 12 (i.e., the resin) comes in contact with the coil 11 directly and tightly, a case 13 accommodating therein the coil 11 and the core 12, and cooling pipes 14 as a cooling member, which are arranged being in contact with the core 12.

The cooling pipes are ensured to be embedded in the core 12 with a coolant 141 flowing therethrough.

The magnetic powder-containing resin structuring the core 12 is a material obtained by mixing a magnetic powder into a resin. The magnetic powder includes, for example, ferrite powders, iron powders and silicon alloy iron powders. The resin may include thermosetting resins, such as epoxy resins, and thermoplastic resins.

The case 13 and the cooling pipes 14 are made such as of aluminum. The coolant may include water mixed with ethylene glycol based antifreeze, natural coolant such as water and ammonia, fluorocarbon coolant such as Fluorinert®, chlorofluorocarbon coolant such as HCFC123 and HFC134a, alcohol coolant such as methanol and alcohol, and ketone coolant such as acetone.

A power converter 2 incorporating the reactor 1 according to the present embodiment will be explained below.

As shown in FIG. 2, the power converter 2 includes a plurality of semiconductor modules 21 each incorporating a semiconductor device, a cooler 3 for cooling the semiconductor modules 21, and the reactor 1 electrically connected to the semiconductor module 21.

The cooler 3 is provided with a plurality of cooling tubes 31 each arranged being in contact with mutually-facing sides of mutually-adjacent semiconductor module 21, a connecting pipe 32 for connecting the plurality of cooling tubes 31 to each other, a charge pipe 33 for charging a coolant 141, and a discharge pipe 34 for discharging the coolant 141. The charge pipe 33 and the discharge pipe 34 are partially embedded in the core 12 of the reactor 1. In other words, the charge pipe 33 and the discharge pipe 34 serve as the cooling pipes 14 shown in FIG. 1.

The power converter 2 is structured by the plurality of semiconductor modules 21 and the plurality of cooling tubes 31, which are stacked alternately. The coolant 141 introduced from the charge pipe 33 flows through the cooler 3 and is distributed to each of the cooling tubes 31. This allows heat exchange to occur between the semiconductor modules 21 each arranged being in contact with the cooling tubes 31 to thereby cool the semiconductor modules 21.

The coolant 141 that has passed through the cooling tubes 31 and has received heat from the semiconductor modules 21 is discharged via the discharge pipe 34.

In this way, the coolant 141 is charged from the charge pipe 33 and discharged from the discharge pipe 34. While the coolant 141 flows through the charge pipe 33 and the discharge pipe 34, heat exchange is performed between the reactor 1 and the coolant 141 so that the reactor 1 can be cooled.

Fabrication of the reactor 1 of the present embodiment is now explained below with reference to FIG. 3.

The coil 11 and the cooling pipes are first set at a predetermined position in the case 13. Subsequently, magnetic powder-containing resin liquid 120 is injected into the case 13, and heated at a predetermined temperature for a predetermined period of time, followed by curing the magnetic powder-containing resin liquid 120 to thereby form the core 12.

It should be appreciated that an end of the winding, or a lead 111, of the coil 11 is ensured to protrude outside from the core 12.

The advantages of the present embodiment are described below.

In the reactor 1, the cooling pipes 14 are embedded in the core 12. This may ensure a large contact area between each of the cooling pipes 14 and the reactor 1, and at the same time may allow heat of the reactor 1 to be radiated from inside the core 12. In particular, current supply to the coil 11 causes heat generation, which heat is transferred to the core 12. The heat in the core 12 is then radiated from the full perimeter of each cooling pipe 14 embedded therein. Heat can thus be efficiently radiated from the reactor 1.

As a result, the operational stability of the reactor 1 can be ensured.

Since the core 12 is made of magnetic powder-containing resin, the cooling pipes 14 can be readily embedded in the core 12. For example, as described above, magnetic powder-containing resin can be filled in the case 13 and then can be cured in the state where the cooling pipes 14 and the coil 11 are arranged at predetermined positions in the case 13. Thus, the cooling pipes 14 can be directly embedded in the core 12 with ease.

With the power converter 2 according to the present embodiment, the cooler 3 for cooling the semiconductor modules 21 can also be used for cooling the reactor 1, whereby the converter can readily be reduced in the size.

Moreover, partial direct embedment of the charge pipe 33 and the discharge pipe 34 of the cooler 3 in the core 12 of the reactor 1 can ensure efficient cooling of the reactor 1 and readily allow further reduction in the size of the power converter 2.

As described above, the present embodiment can provide a reactor having excellent heat radiation properties and a power converter using the reactor.

(Second Embodiment)

A second embodiment of the present invention will now be described with reference to FIG. 4. In the present embodiment and in the subsequent embodiments, the identical or similar components to those in the first embodiment are given the same reference numerals for the sake of simplifying or omitting the explanation.

Figure 4:
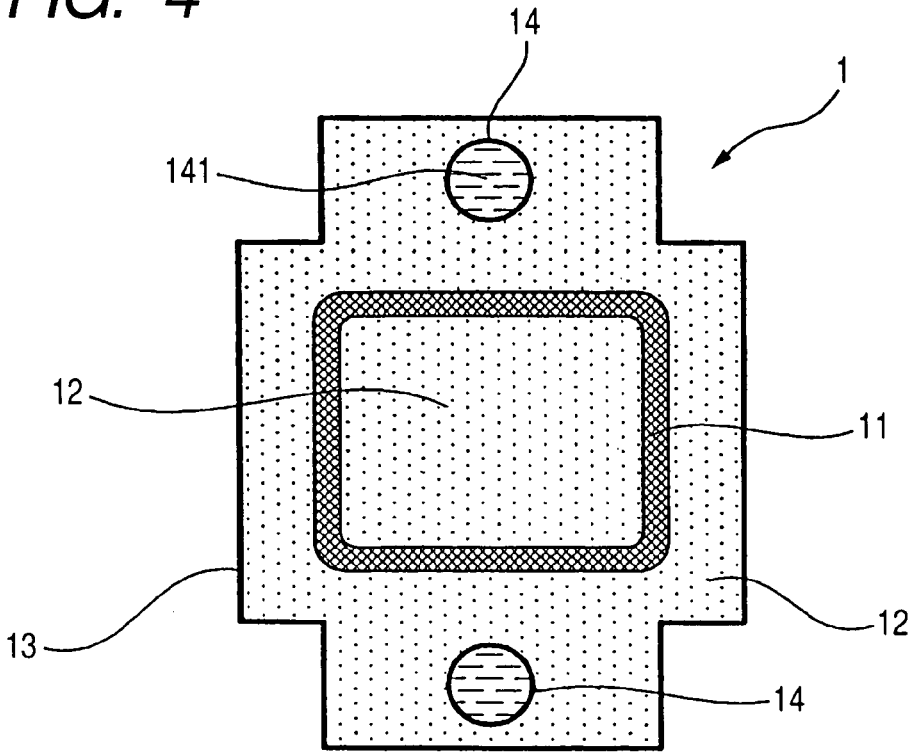
FIG. 4 is an explanatory cross sectional view illustrating a section of a reactor used in a second embodiment of the present invention.

As shown in FIG. 4, the reactor 1 of the present embodiment is provided with the cooling pipes 14 which are embedded above and below the coil 11 in the core 12 in FIG. 4.

The rest of the reactor 1 is similar to the first embodiment.

Similar advantages to those of the first embodiment can be achieved in the present embodiment.

(Third Embodiment)

A fifth embodiment of the present invention is described below with reference to FIG. 5.

Figure 5:
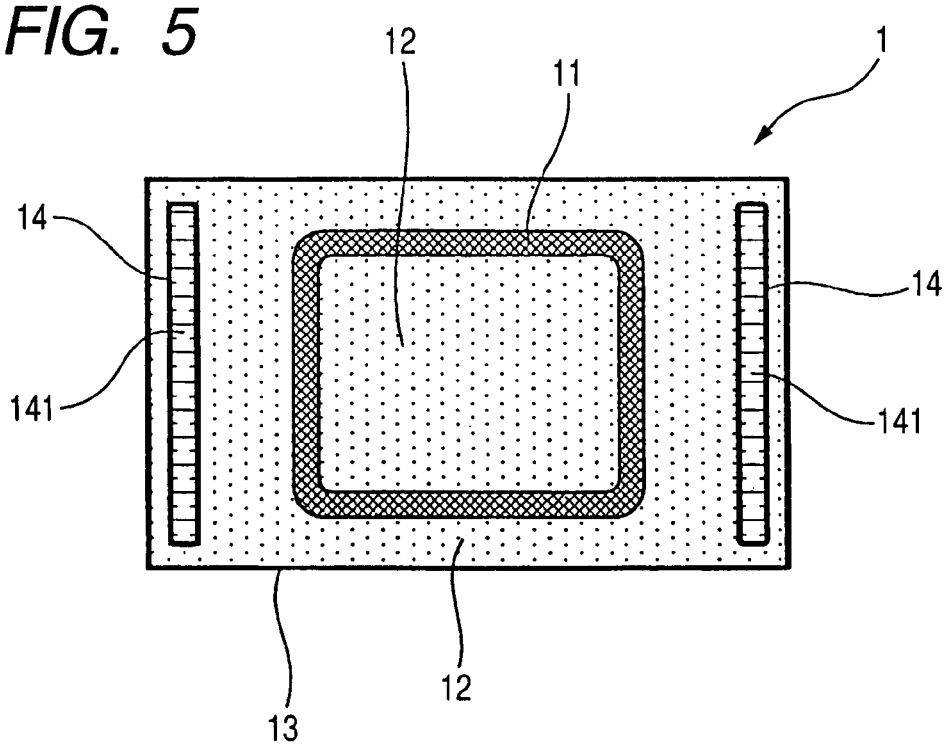
FIG. 5 is an explanatory cross sectional view illustrating a section of a reactor used in a third embodiment of the present invention.

As shown in FIG. 5, the reactor 1 of the present embodiment is provided with the cooling pipes 14 each of which is formed into a flat shape and embedded in the core 12 outside the coil 11.

The rest of the reactor 1 is similar to the first embodiment.

In the present embodiment, heat generated from the coil 11 can be more uniformly radiated to enable so much the more efficient cooling.

In addition to the above advantage, similar advantages to those of the first embodiment can be achieved in the present embodiment.

(Fourth Embodiment)

A fourth embodiment of the present invention is described below with reference to FIG. 6.

Figure 6:
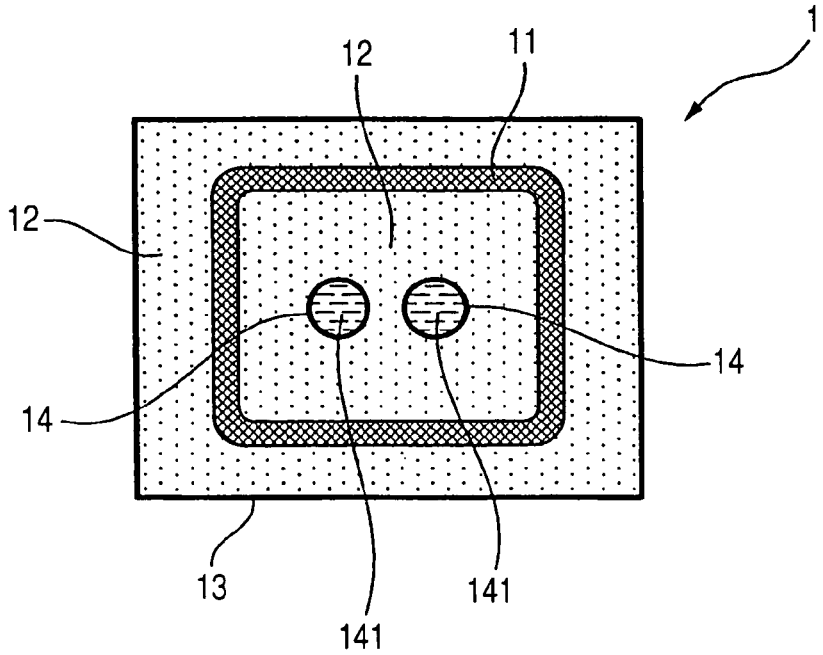
FIG. 6 a an explanatory cross sectional view illustrating a section of a reactor used in a fourth embodiment of the present invention.

As shown in FIG. 6, the reactor 1 of the present embodiment is provided with the cooling pipes 14 which are embedded in the core 12 inside the coil 11. In other words, the charge pipe 33 and the discharge pipe 34, which form portions of the respective cooling pipes 14 of the cooler 3 (see FIG. 2), are provided in such a way that the pipes 33 and 34 pass through the inside of the coil 11 of the reactor 1 in its winding direction (, which is an axial direction of the wound coil body and is perpendicular to the drawing of FIG. 6).

Figure 7:
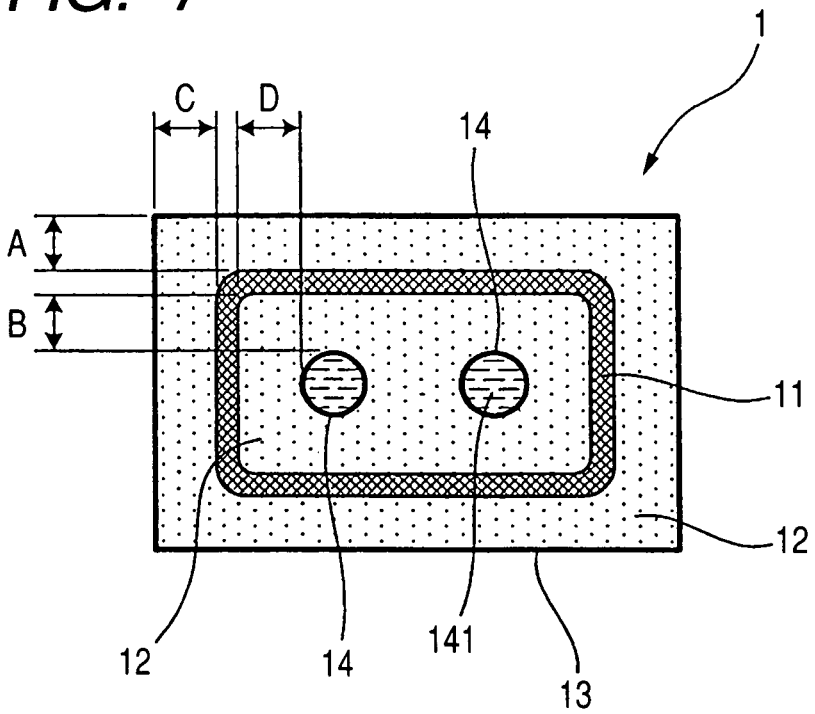
FIG. 7 is an explanatory view illustrating a positional relationship between a coil and a cooling pipe used in the fourth embodiment.

As can be seen from FIGS. 6 and 7, various positional relations can be established between the coil 11 and each cooling pipe 14, but the relations should preferably satisfy the following requirements. Specifically, on a plane each perpendicular to the winding direction of the coil 11, distances B and D between each cooling pipe 14 and the coil 11 should be equal to or more than distances A and C, respectively, between the coil 11 and the case 13. In other words, B>A and D>C should preferably be satisfied.

The rest of the present embodiment is similar to the first embodiment.

The reactor 1 of the present embodiment can further enhance the heat radiation efficiency.

Particularly, heat generated by the coil 11 tends to stay inside the coil 11 due to the structure of the reactor 1. The arrangement of the cooling pipes 14 inside the coil 11 where heat tends to stay can thus be led to efficient heat radiation of the reactor 1.

In addition, since the core 12 located inside the coil 11 is made of magnetic powder-containing resin as described above, the cooling pipes 14 can be readily embedded inside the coil 11. Specifically, where a reactor is formed by winding a coil around a core made such as of iron as in the conventional art, providing cooling pipes through the inside of the coil may be difficult. However, according to the present invention, the cooling pipes 14 can be readily provided through the inside of the coil 11.

The distances B and D between each cooling pipe 14 and the coil 11 on a plane perpendicular to the winding direction of the coil 11 around which the coil element is wound, are equal to or more than the distances A and C, respectively, between the coil 11 and the case 13. Therefore, the cooling pipes 14 arranged inside the coil 11 may not inhibit the formation of the magnetic flux generated over the inner and outer peripheries (spaces) of the coil 11. In other words, substantially uniform loops of magnetic flux path may be formed over the inner and outer peripheries (species) of the coil 11 by supplying current to the coil 11. On the other hand, in case each cooling pipe 14 resides in a portion of the path where magnetic flux should be formed, the core 12 cannot be present in the portion. In particular, if the cooling pipes 14 are made up of a non-magnetic body, the formation of the magnetic flux may be inhibited.

Thus, by ensuring the thicknesses B and D of the core 12 inside the coil 11 to be equal to or more than the thicknesses A and C of the core 12 outside the coil 11, the formation of the magnetic flux is prevented from being inhibited by the cooling pipes 14.

The cooling efficiency can thus be enhanced without deteriorating the performance of the reactor 1.

The advantages attained by the rest of the present embodiment are similar to those of the first embodiment.

(Fifth Embodiment)

A fifth embodiment of the present invention is now described with reference to FIGS. 8 and 9.

Figure 8:
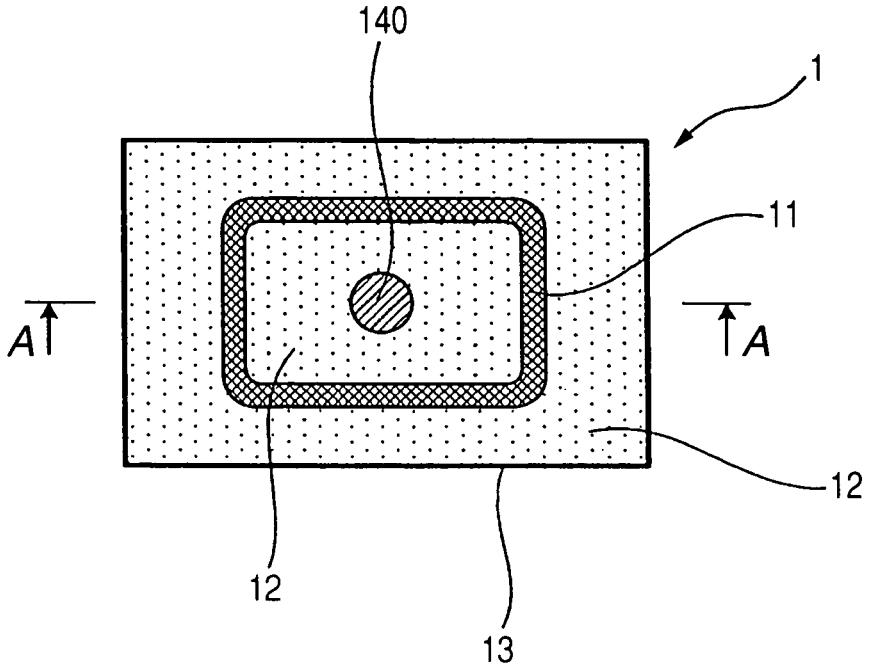
FIG. 8 is an explanatory cross sectional view illustrating a section of a reactor used in a fifth embodiment of the present invention.
Figure 9:
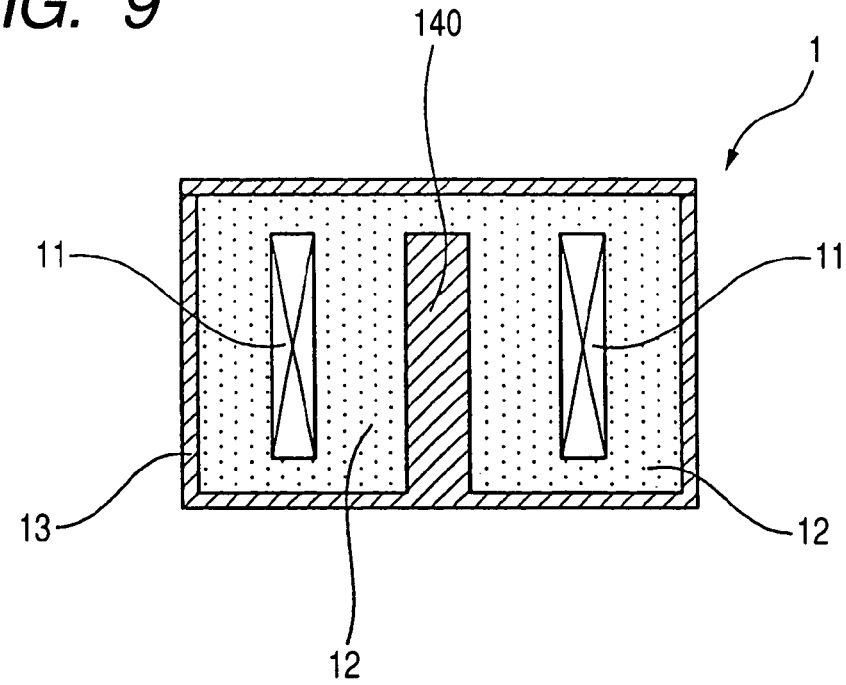
FIG. 9 is a cross sectional view taken along a line A-A of FIG. 8.

As shown in FIGS. 8 and 9, the reactor 1 provided by the present embodiment has a projection 140, which is integrated with the case 13, as a cooling member for cooling the reactor 1.

Specifically, the projection 140 is embedded in the core 12 of the reactor 1 to have it served as a cooling member for radiating heat of the reactor 1. The projection 140 is integrated into the case 13 made of aluminum, and the projection 140, per se, is made of aluminum.

FIG. 9 is a cross sectional view taken along a line A-A of FIG. 8. As shown in FIG. 9, the projection 140 is formed being projected from a bottom surface of the case 13 and arranged inside the coil 11. It should be appreciated that the projection 140 may be formed projecting not only from the bottom surface of the case 13, but also from a top surface or a side face of the case 13.

The rest of the present embodiment is similar to the first embodiment.

In the present embodiment, the heat staying inside the coil 11 may be allowed to escape therefrom to the case 13 via the projection 140.

The advantages attained by the rest of the present embodiment are similar to those of the first embodiment.

In the present embodiment, the projection 140 has been arranged inside the coil 11, however, the projection 140 may be buried in the core 12 outside the coil 11.

(Sixth Embodiment)

A sixth embodiment of the present invention is now described with reference to FIG. 10.

Figure 10:
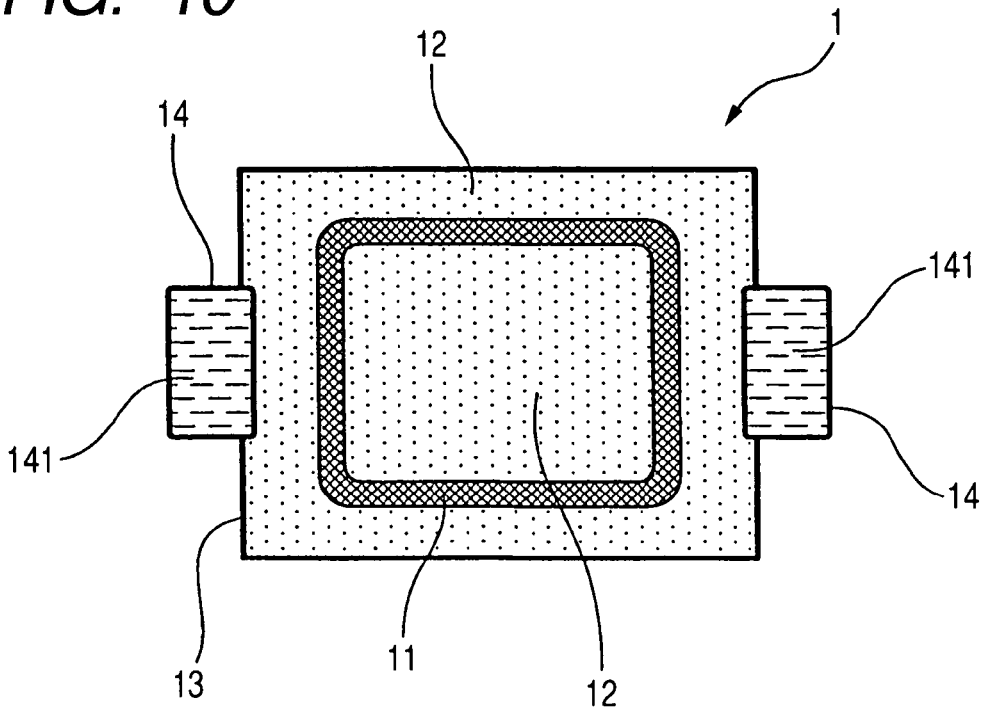
FIG. 10 is an explanatory cross sectional view illustrating a section of a reactor used in a sixth embodiment of the present invention.

As shown in FIG. 10, the cooling pipes 14 of the present embodiment are arranged outside the coil 11 which is in contact with the core 12. The outer surface of the core 12 is, in part, closely in contact with a portion of a surface of each cooling pipe 14.

The rest of the present embodiment is similar to the first embodiment.

In the reactor 1 of the present embodiment, as in the above embodiments, each of the cooling pipes 14 is arranged being in contact with the core 12 which is made of magnetic powder-containing resin, and a large contact area is attained between each cooling pipe 14 and the reactor 1. As a result, heat radiation can be efficiently performed. In particular, the core 12 made of magnetic powder-containing resin may allow its shape to be in conformity with and in close contact with the surface of each cooling pipe 14. This may contribute to enlarging the contact area between each cooling pipe 14 and the reactor 1.

Thus, a supply of current to the coil 11 may cause heat generation, which heat may then be transferred to the core 12. The heat in the core 12 can thus be radiated from each cooling pipe 14 closely in contact with the core 12, so that the reactor 1 can efficiently perform heat radiation.

The advantages attained by the rest of the present embodiment are similar to those of the first embodiment.

(Seventh Embodiment)

A seventh embodiment of the present invention is now described with reference to FIG. 11.

Figure 11:
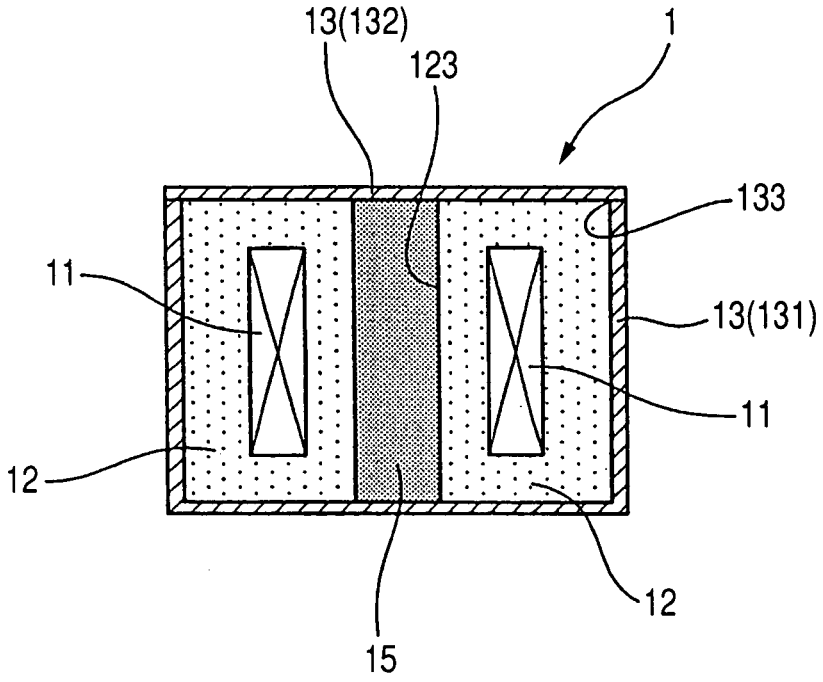
FIG. 11 is an explanatory cross sectional view illustrating a section of a reactor used in a seventh embodiment of the present invention.

As shown in FIG. 11, the reactor 1 of the present embodiment is so arranged that a magnetic body 15 as a cooling member for cooling the reactor 1 is brought into contact with or connected to the case 13.

Specifically, the magnetic body 15 as a cooling member is provided being embedded in the core 12 of the reactor 1 so as to perform heat radiation of the reactor 1.

The magnetic body 15 is in contact with or connected by welding, for example, to a body 131 and a cover 132 of the case 13 made of aluminum, for example. The magnetic body 15 is made of iron, for example, and has higher magnetic permeability than the core 11.

As shown in FIG. 11, the magnetic body 15 is embedded inside the coil 11.

The magnetic body 15 is inserted and fitted to a center hole 123 in the core 12, and both end portions of the magnetic body 15 is in contact with or connected to the case 13.

Alternative to this, the reactor 1 of the present embodiment may arranged by allowing only one end portion of the magnetic body 15 to be in contact with or connected to the case 13.

The rest of the present embodiment is similar to the fifth embodiment.

The advantages of the present embodiment are described below.

The cooling member is made up of the magnetic body 15 and is embedded in the core 12 which is filled in the inside of the coil 11. As shown in FIG. 11, the magnetic body 15 is in contact with or connected to the case 13. The size of the reactor 1 therefore can be reduced, and at the same time, heat radiation efficiency of the reactor 1 can be enhanced. In achieving the reduction in size, a simple reduction in the outer diameter of the coil 11 for the reduction of the area surrounded by the coil 11 may cause the inductance of the reactor 1 to decrease.

As described above however the embedment of the magnetic body 15 inside the core 12 may enhance the magnetic permeability as a whole, which is exerted by both the core 12 made of magnetic powder-containing resin and the magnetic body 15. Therefore, reduced diameter of the coil 11 with closer arrangement thereof to the magnetic body 15 may ensure sufficient inductance performance of the reactor 1 without the necessity of increasing the number of windings of the coil 11 and may reduce the size of the reactor 1.

Further, since the magnetic body 15 is in contact with the case 13, heat radiation efficiency of the reactor 1 can be enhanced. In other words, since the magnetic flux is collectively formed inside the coil 11, the temperature inside the coil 11 is raised, so that the temperature of the magnetic body 15 is also raised. Thus, the fact that the magnetic body 15 is in contact with or connected to the case 13 may allow the heat inside the coil 11 to be transferred from the magnetic body 15 to the case 13, which heat would otherwise have been comparatively difficult to be radiated. In this way, the heat radiation efficiency of the reactor 1 can be enhanced.

In addition, the magnetic permeability of the magnetic body 15, which is higher than the core 12, may sufficiently enhance the magnetic permeability as a whole exerted by both the core 12 made of magnetic powder-containing resin and the magnetic body 15. The inductance performance of the reactor 1 may thus be ensured with its size being sufficiently reduced.

The advantages attained by the rest of the present embodiment are similar to those of the fifth embodiment.

(Eighth Embodiment)

Figure 12A:
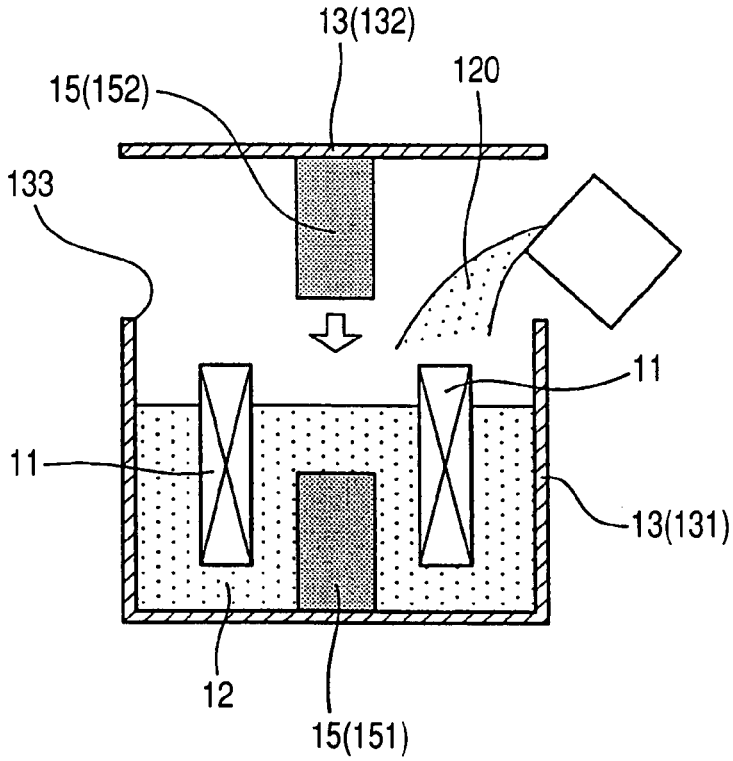
FIG. 12A is an explanatory view illustrating how to fabricate a reactor used in an eighth embodiment of the present invention.
Figure 12B:
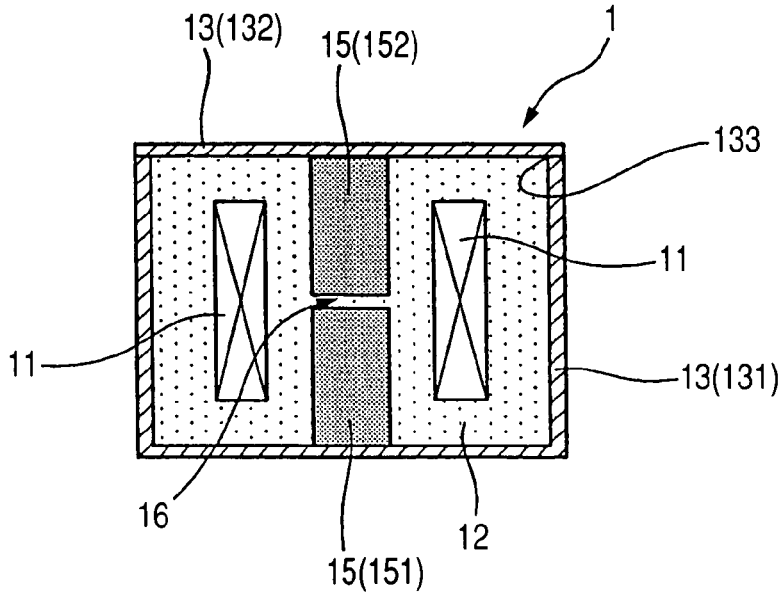
FIG. 12B is an explanatory cross sectional view illustrating a section of the reactor used in the eighth embodiment.

With reference to FIGS. 12A and 12B, an eighth embodiment of the present invention will be described.

As shown in FIGS. 12A and 12B, the magnetic body 15 of the reactor 1 according to the present embodiment is structured by two members.

Specifically, as shown in FIGS. 12A and 12B, the magnetic body 15 is made up of a first magnetic member 151 connected to a body 131 of the case 13 and a second magnetic member 152 connected to a cover 132 of the case 13.

As shown in FIG. 12B, in the magnetic body 15, an end portion of the first magnetic member 151 and an end portion of the second magnetic member 152 opposed thereto are distanced from each other to provide a gap 16 therebetween.

Fabrication of the reactor 1 according to the present embodiment is explained below.

As shown in FIG. 12A, for example, the first magnetic member 151 is connected to the body 131 of the case 13 by welding or the like. Similarly, the second magnetic member 152 is connected to the cover 132 of the case 13 by welding or the like. Subsequently, the coil 11 is arranged at a predetermined position in the body 131 of the case 13, followed by injecting the magnetic powder-containing resin liquid 120 into the case 13.

After injecting a predetermined amount of the magnetic powder-containing resin liquid 120, an opening 133 of the body 131 is fixedly covered with the cover 132 of the case 13, to which the second magnetic member 152 is connected. In this case, the second magnetic member 152 is immersed in the magnetic powder-containing resin liquid 120, so that an end portion thereof faces an end portion of the first magnetic member 151. In this state, heating is performed at a predetermined temperature for a predetermined period to cure the magnetic powder-containing resin liquid 120. As a result, the reactor 1 of the present embodiment is formed as shown in FIG. 12B.

The rest of the present embodiment is similar to the seventh embodiment.

The advantages of the present embodiment are described below.

As shown in FIG. 12B, the magnetic body 15 is structured by the first magnetic member 151 connected to the body 131 of the case 13 and the second magnetic member 152 connected to the cover 152 of the case 13 with an end portion of the first magnetic member 151 being located opposed to an end portion of the second magnetic member 152. This may allow the magnetic body 15 to be readily located at a predetermined position, whereby the reactor 1 may be readily formed.

As shown in FIG. 12B, the magnetic body 15 has the gap 16 formed between the end portion of the first magnetic member 151 and the end portion of the second magnetic member 152. This structure may prevent magnetic saturation inside the coil 11, thereby providing the reactor 1 having inductance performance which is sufficient for a possible flow of a large current.

When the magnetic body 15 having high magnetic permeability is embedded inside the coil 11 as described above, a problem as provided below may arise. That is, a large current that may flow through the circuit may bring about magnetic saturation due to the magnetic flux collectively formed at the magnetic body 15, causing a problem of reducing the inductance of the reactor 1.

By providing the gap 16 as mentioned above, the collectively formed flux can be distributed through the gap 16 to portions of the magnetic body 15 where the magnetic flux is less collectively formed. Thus, the collective formation of the magnetic flux inside the coil 11 can be prevented. This may lead to the prevention of the magnetic saturation inside the coil 11 to provide the reactor 1 ensured with inductance performance which is sufficient for a possible large flow of a current through the coil 11.

The rest of the present embodiment is similar to the seventh embodiment.

The features of the present invention embodied by the various embodiments described above can be summed up as follows.

A feature of the reactor according to the present invention is that it includes a coil for generating magnetic flux upon supply of current, a core made of magnetic powder-containing resin filled in the spaces inside and outside the core, a case for accommodating therein the coil and the core, and a cooling member.

A feature of the power converter according to the present invention is that it includes a plurality of semiconductor modules each incorporating a semiconductor device, a cooler for cooling the semiconductor modules, and a reactor electrically connected to the semiconductor modules, wherein: the reactor includes a coil for generating magnetic flux upon supply of current, a core made of magnetic powder containing-resin filled in the spaces inside and outside the core, a case for accommodating therein the coil and the core, and a cooling member; and the cooler is located partially being directly in contact with the core of the reactor.

In each of the basic arrangements of the reactor and the power converter as described above, the magnetic powder-containing resin is a material obtained, for example, by mixing a magnetic powder into a resin. The magnetic powder includes, for example, ferrite powders, iron powders and silicon alloy iron powders. The resin includes, for example, thermosetting resins, such as epoxy resins, and thermoplastic resins.

In the basic arrangement of the reactor, it is preferable that the cooling member is embedded in the core.

In this case, a large contact area can be ensured between the cooling member and at the same time the reactor can radiate heat from inside the core. Specifically, supply of current causes heat generation, and the heat is transferred to the core. The heat in the core may then be radiated from the full perimeter of the cooling member embedded in the core. Thus, heat radiation of the reactor can be efficiently performed.

The core made of magnetic powder-containing resin may facilitate the embedment of the cooling member in the core. Specifically, for example, the magnetic powder-containing resin can be filled in the case and then can be cured in the state where the cooling member as well as the coil is arranged at a predetermined position in the case. Thus, the cooling member can be readily embedded in the core.

The cooling member may preferably be arranged inside the coil. In this case, heat radiation efficiency of the reactor can be further enhanced. Specifically, heat generated by the coil tends to stay inside the coil due to the structure of the reactor. The arrangement of the cooling member inside the coil where heat tends to stay may thus enable efficient heat radiation of the reactor.

In addition, since the core arranged inside the coil is made of magnetic powder-containing resin as described above, the cooling member can be readily embedded inside the core.

It is preferable that, in a line perpendicular to the winding direction or the coil, a distance between the cooling member and the coil may be equal to or larger than a distance between the coil and the case.

In this case, the cooling member arranged inside the coil may not inhibit the formation of the flux generated over the inner and outer peripheries of the coil. In other words, substantially uniform loops of magnetic flux path may be formed over the inner and outer peripheries of the coil by supplying current to the coil. On the other hand, in case the cooling member resides in a portion of the path where magnetic flux should be formed, the core cannot be present in the portion. In particular, if the cooling member is made up of a non-magnetic body, the formation of the magnetic flux may be inhibited. By allowing the thickness of the core inside the coil to be equal to or larger than the thickness of the core outside the coil, the formation of the magnetic flux is prevented from being inhibited by the cooling member.

The cooling efficiency can thus be enhanced without deteriorating the performance of the reactor.

The cooling member may preferably be structured by a cooling pipe through which a coolant is flowed. In this case, a reactor having more excellent cooling efficiency can be obtained.

Alternatively, the cooling member may be structured by a projection which is integrated into the case. In this case, the heat staying inside the coil may be allowed to escape therefrom to the case via the projection.

Hereinafter are explained some specifics about the basic arrangement of the power converter described above. Such a power converter includes, for example, a DC-DC converter and an inverter. This power converter may be used for producing drive current to be supplied, for example, to an AC motor that is a power source for an electric vehicle and a hybrid powered vehicle.

Each semiconductor module is constructed with a semiconductor device, such as an IGBT element, being incorporated therein, and constitutes a portion of a power converter circuit.

It is preferable that the cooler is partially embedded in the core. In this case, a large contact area can be ensured between the cooling member and the reactor. At the same time, the reactor can radiate heat from inside the core to perform efficient heat radiation.

It is preferable that the cooler may include a plurality of cooling tubes each arranged being in contact with mutually-facing sides of mutually-adjacent semiconductor modules, a connecting pipe for connecting the plurality of cooling tubes to each other, a charge pipe for charging a coolant, and a discharge pipe for discharging the coolant, and that the charge pipe and the discharge pipe are arranged being partially in contact with the core of the reactor. In this case, the reactor can be efficiently cooled and the size of the power converter can be readily reduced.

A portion of the cooler may preferably be arranged inside the coil. In this case, it is possible to obtain a power converter with a reactor having more excellent cooling efficiency.

It is preferable that, in a line perpendicular to the winding direction of the coil, a distance between the portion of the cooler and the coil may be equal to or larger than a distance between the coil and the case. In this case, the cooling member arranged inside the coil may not inhibit the formation of the flux generated over the inner and outer peripheries of the coil.

It is preferable that the cooling member is made up of a magnetic body which is embedded inside the core that has been filled in the inside of the coil, and that the magnetic body is in contact with or connected to the case. In this case, the size of the reactor can be reduced, and the heat radiation efficiency can be enhanced while ensuring the inductance performance. Simple reduction in the outer diameter of the coil for the reduction of the area surrounded by the coil may cause the inductance of the reactor to decrease.

As described above however the embedment of the magnetic body inside the core made of magnetic powder-containing resin may enhance the magnetic permeability as a whole, which is exerted by both the core made of magnetic powder-containing resin and the magnetic body. Therefore, a reduced diameter of the coil with closer arrangement thereof to the magnetic body may ensure sufficient inductance performance of the reactor without the necessity of increasing the number of windings of the coil and may reduce the size of the reactor.

Further, since the magnetic body is in contact with or connected to the case, the heat radiation efficiency of the reactor can be enhanced. Specifically, the collective formation of the magnetic flux inside the coil may raise the temperature inside the coil, so that the temperature of the magnetic body may also be raised. Thus, the fact that the magnetic body is in contact with or connected to the case may allow the heat inside the coil to be transferred from the magnetic body to the case, which heat would otherwise have been comparatively difficult to be radiated. In this way, the heat radiation efficiency of the reactor can be enhanced.

It should be appreciated that materials of the magnetic body include, for example, iron, silicon steel, permalloys, Permendur, ferrite, amorphous magnetic alloys and sendust.

The magnetic body may preferably have higher magnetic permeability than the core made of magnetic powder-containing resin. In this case, the arrangement of such a magnetic body may enhance the magnetic permeability as a whole, which is exerted by both the core made of magnetic powder-containing resin and the magnetic body. Thus, the size of the reactor can sufficiently be reduced while ensuring the inductance performance of the reactor.

It is preferable that: the case is structured by a body having an accommodation recess for accommodating therein the coil and the core, and a cover for closing an opening of the body; the magnetic body is structured by a first magnetic member which is in contact with or connected to the body of the case and a second magnetic member which is in contact with or connected to the cover of the case; and the first and the second magnetic members are located with their end portions being opposed to each other.

In this case, the magnetic body can be readily located at a predetermined position, which may facilitate formation of the reactor. In addition, formation of the heat radiation paths can be ensured, starting from the first magnetic member through the body of the case and starting from the second magnetic member through the cover of the case, whereby heat radiation efficiency of the reactor can be enhance.

The magnetic body may preferably have a gap between the first and second magnetic members, the gap being formed by allowing the end portions of the first and second magnetic members to be apart from each other. In this case, the magnetic saturation may be prevented from occurring inside the coil. Thus, it is possible to obtain a reactor having the inductance performance sufficient for a large current that may flow through the coil.

Where the magnetic body having high magnetic permeability is embedded inside the coil as described above, the following problem may arise. That is, a large current that may flow through the circuit may bring about magnetic saturation due to the magnetic flux collectively formed at the magnetic body, causing a problem of reducing the inductance of the reactor.

By providing the gap as mentioned above, the collectively formed flux can be distributed through the gap to portions of the magnetic body where the magnetic flux is less collectively formed. Thus, the collective formation of the magnetic flux inside the coil can be prevented. This may lead to the prevention of the magnetic saturation inside the coil to provide the reactor ensured with inductance performance which is sufficient for a possible large flow of current through the coil.

It should be appreciated that the gap may be filled with the core made of magnetic powder-containing resin, or may be filled with a different material, such as a non-magnetic body. Alternatively, the gap may be a hollow.

The present invention may be embodied in several other forms without departing from the spirit thereof. The embodiments and modifications described so far are therefore intended to be only illustrative and not restrictive, since the scope of the present invention is defined by the appended claims rather than by the description preceding them. All changes that fall within the metes and bounds of the claims, or equivalents of such metes and bounds, are therefore intended to be embraced by the claims.

What is claimed is:

1. A reactor comprising:

a case;

a loop shaped coil formed to have windings wound in a loop shape such that the wound windings provide an inside space surrounded by the wound windings, and accommodated in the case such that an outside space is present between the loop shaped coil and the case, wherein the loop shaped coil generates magnetic flux in response to a supply of current thereto, such that the generated magnetic flux circulates through the inside and outside spaces a core made of magnetic powder-containing resin filled in the inside and outside spaces; and a cooling member arranged to be entirely embedded in the core in the inside space such that the cooling member is in contact with the core in the inside space, wherein the cooling member is formed as a projection inwardly projecting from the case in an axial direction of the windings of the coil.

2. The reactor according to claim 1, wherein said cooling member is structured by a cooling pipe for allowing a coolant to flow therethrough.

3. The reactor according to claim 1, wherein said cooling member is structured by a cooling pipe for allowing a coolant to flow therethrough.

4. The reactor according to claim 1, wherein said cooling member is structured by a cooling pipe for allowing a coolant to flow therethrough.

5. The reactor according to claim 1, wherein said cooling member is structured by a magnetic body embedded in said core which is filled in the inside of said coil, said magnetic body being in contact with or connected to said case.

6. The reactor according to claim 5, wherein said magnetic body has higher magnetic permeability than said core made of magnetic powder-containing resin.

7. The reactor according to claim 6, wherein said case is structured by a body having an accommodation recess for accommodating therein said coil and said core, and a cover for closing an opening of said body, said magnetic body being structured by a first magnetic member which is in contact with or connected to said body of the case, and a second magnetic member which is in contact with or connected to said cover of the case, and an end portion of said first magnetic member and an end portion of said second magnetic member are arranged being opposed to each other.

8. The reactor according to claim 7, wherein said magnetic body comprises a gap between said first and second magnetic members, said gap being formed by allowing the end portion of said first magnetic member to be arranged being apart from the end portion of said second magnetic member.

9. The reactor according to claim 5, wherein said case is structured by a body having an accommodation recess for accommodating therein said coil and said core, and a cover for closing an opening of said body, said magnetic body being structured by a first magnetic member which is in contact with or connected to said body of the case, and a second magnetic member which is in contact with or connected to said cover of the case, and an end portion of said first magnetic member and an end portion of said second magnetic member are arranged being opposed to each other.

10. The reactor according to claim 1, wherein said cooling member is structured by a magnetic body embedded in said core which is filled in the inside of said coil, said magnetic body being in contact with or connected to said case.

11. The reactor according to claim 10, wherein said magnetic body has higher magnetic permeability than said core made of magnetic powder-containing resin.

12. The reactor according to claim 11, wherein said case is structured by a body having an accommodation recess for accommodating therein said coil and said core, and a cover for closing an opening of said body, said magnetic body being structured by a first magnetic member which is in contact with or connected to said body of the case, and a second magnetic member which is in contact with or connected to said cover of the case, and an end portion of said first magnetic member and an end portion of said second magnetic member are arranged being opposed to each other.

13. The reactor according to claim 12, wherein said magnetic body comprises a gap between said first and second magnetic members, said gap being formed by allowing the end portion of said first magnetic member to be arranged being apart from the end portion of said second magnetic member.

14. The reactor according to claim 10, wherein said case is structured by a body having an accommodation recess for accommodating therein said coil and said core, and a cover for closing an opening of said body, said magnetic body being structured by a first magnetic member which is in contact with or connected to said body of the case, and a second magnetic member which is in contact with or connected to said cover of the case, and an end portion of said first magnetic member and an end portion of said second magnetic member are arranged being opposed to each other.

15. The reactor of claim 1, wherein the core filled in the inside space is in contact with an inside portion of the wound windings of the coil.

16. The reactor of claim 1, wherein the case has a wall and the projection is integrally formed with the wall of the case.

17. The reactor of claim 16, wherein the wall is a bottom of the case, and the projection is rod-shaped and integrally formed with the bottom such that the projection is protruded from the bottom.

18. The reactor of claim 17, wherein the rod-shaped projection has a free end which is free from being integrated from the case, the free end being embedded in the core filled in the inside space.

19. The reactor of claim 16, wherein the core filled in the inside space of coil is contact with an inside portion of the windings of the coil.

20. The reactor of claim 1, wherein the rod-shaped projection has a free end which is free from being integrated from the case, the free end being embedded in the core filled in the inside space.

21. The reactor of claim 1, wherein the projection is aligned with a central axis of the coil, the central axis passing through the inside space.

* * * * *